US007160179B2

(12) United States Patent
Custer et al.

(10) Patent No.: US 7,160,179 B2
(45) **Date of Patent: *Jan. 9, 2007**

(54) METHODS FOR MECHANICAL OR CHEMICAL-MECHANICAL PLANARIZATION OF MICROELECTRONIC-DEVICE SUBSTRATE ASSEMBLIES

(75) Inventors: Daniel G. Custer, Caldwell, ID (US); Aaron Trent Ward, Kuna, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/193,087

(22) Filed: Jul. 29, 2005

(65) Prior Publication Data

US 2005/0260931 A1 Nov. 24, 2005

Related U.S. Application Data

(60) Division of application No. 10/935,839, filed on Sep. 7, 2004, now Pat. No. 7,014,535, which is a continuation of application No. 10/457,883, filed on Jun. 9, 2003, now Pat. No. 6,787,055, which is a division of application No. 09/295,019, filed on Apr. 20, 1999, now Pat. No. 6,227,955.

(51) Int. Cl.
*B44C 1/22* (2006.01)

(52) U.S. Cl. ..... 451/41; 451/28; 451/285; 451/388; 216/92

(58) Field of Classification Search ..... 451/28, 451/41, 285–290, 388, 398; 216/88, 89, 216/92; 134/25.4; 156/345.12; 51/131.3
See application file for complete search history.

(56) References Cited

U.S. PATENT DOCUMENTS 5,618,354 A 4/1997 Lofaro ..... 134/25.4

(Continued)

*Primary Examiner*—Lee D. Wilson
*Assistant Examiner*—Anthony Ojini
(74) *Attorney, Agent, or Firm*—Dorsey & Whitney, LLP

(57) ABSTRACT

Planarizing machines, carrier heads for planarizing machines and methods for planarizing microelectronic-device substrate assemblies in mechanical or chemical-mechanical planarizing processes. In one embodiment of the invention, a carrier head includes a backing plate, a bladder attached to the backing plate, and a retaining ring extending around the backing plate. The backing plate has a perimeter edge, a first surface, and a second surface opposite the first surface. The second surface of the backing plate can have a perimeter region extending inwardly from the perimeter edge and an interior region extending inwardly from the perimeter region. The perimeter region, for example, can have a curved section extending inwardly from the perimeter edge of the backing plate or from a flat rim at the perimeter edge. The curved section can curve toward and/or away from the first surface to influence the edge pressure exerted against the substrate assembly during planarization. The second surface of the backing plate is a fixed, permanent surface. The backing plate can further include a permanent, low-friction coating over at least a portion of the perimeter region. The bladder is configured to extend over the second surface of the backing plate to form a fluid cell between the bladder and the second surface.

21 Claims, 5 Drawing Sheets

U.S. PATENT DOCUMENTS 5,618,447 A 4/1997 Sandhu ..... 438/14
5,635,083 A 6/1997 Breivogel et al. ..... 216/88
5,643,053 A * 7/1997 Shendon ..... 451/28
5,762,544 A 6/1998 Zuniga et al. ..... 451/285
5,957,751 A * 9/1999 Govzman et al. ..... 451/8
5,993,302 A 11/1999 Chen et al. ..... 451/285
6,080,050 A * 6/2000 Chen et al. ..... 451/288
6,099,386 A 8/2000 Tsai et al. ..... 451/8
6,132,298 A * 10/2000 Zuniga et al. ..... 451/288
6,146,259 A 11/2000 Zuniga et al. ..... 451/398
6,159,079 A 12/2000 Zuniga et al. ..... 451/41
6,162,116 A 12/2000 Zuniga et al. ..... 451/285

* cited by examiner

METHODS FOR MECHANICAL OR CHEMICAL-MECHANICAL PLANARIZATION OF MICROELECTRONIC-DEVICE SUBSTRATE ASSEMBLIES

CROSS-REFERENCE TO RELATED APPLICATION

This application is a divisional of U.S. patent application Ser. No. 10/935,839, filed Sep. 7, 2004 now U.S. Pat. No. 7,014,535, which is a continuation of U.S. patent application Ser. No. 10/457,883, filed Jun. 9, 2003, now U.S. Pat. No. 6,787,055, which is a divisional of U.S. patent application Ser. No. 09/295,019, filed Apr. 20, 1999, now U.S. Pat. No. 6,227,955.

TECHNICAL FIELD

The present invention relates to carrier heads and methods for forming planar surfaces on microelectronic-device substrate assemblies in mechanical or chemical-mechanical planarizing processes.

BACKGROUND OF THE INVENTION

Mechanical and chemical-mechanical planarizing processes (collectively "CMP") are used in the manufacturing of microelectronic devices for forming flat surfaces on semiconductor wafers, field emission displays and other types of microelectronic-device substrate assemblies. FIG. 1 schematically illustrates a portion of an existing planarizing machine 10 having a rotating platen 20, a carrier assembly 30 and a polishing pad 50. An under-pad 25 can be attached to an upper surface 22 of the platen 20 for supporting the polishing pad 50. In many planarizing machines, a drive assembly 26 rotates (arrow A) and/or reciprocates (arrow B) the platen 20 to move the polishing pad 50 during planarization. In other planarizing machines, such as web-format planarizing machines, the platen 20 remains stationary during planarization and the carrier assembly 30 moves a substrate assembly 12 across the polishing pad 50.

The carrier assembly 30 controls and protects the substrate assembly 12 during planarization. The carrier assembly 30 typically has a drive assembly, a driveshaft 31 coupled to the drive assembly, and a carrier head 33 coupled to the driveshaft 31. The drive assembly typically rotates and/or translates the carrier head 33 to move the substrate assembly 12 across the polishing pad 50 in a linear, orbital and/or rotational motion.

The particular carrier head 33 illustrated in FIG. 1 is manufactured by Applied Materials Corporation. This carrier head includes an external housing 34, a backing plate 40 fixedly attached to the driveshaft 31, and a bladder 46 attached to the backing plate 40. The housing 34 has a support member 35 and a retaining ring 37 depending from the support member 35. A smooth-walled portion of the driveshaft 31 is received in a hole 36 through the support member 35 so that the driveshaft 31 can rotate independently from the housing 34.

The backing plate 40 of the carrier head 33 includes an annular rim 41 having an inner surface 42 extending around the perimeter of the rim 41. The inner surface 42 is a straight, vertical wall extending upwardly from the rim 41. The backing plate 40 also includes a disposable pad 43 adhered to the annular rim 41. The disposable pad 43 is shaped to have a flat interior portion 44 and a curved perimeter portion

45 curving from the interior portion 44 to the rim 41. The pad 43 is a thin, low-friction sheet separate from the backing plate 40 that prevents the bladder 46 from sticking to the backing plate 40 during planarization. The backing plate 40 is received in the housing 34, and a number of inner tubes 49*a* and 49*b* support the housing 34 over the backing plate 40. The backing plate 40 accordingly rotates directly with drive shaft 31 without necessarily rotating with or moving vertically with the housing 34.

The bladder 46 is a thin, flexible membrane attached to the backside or the perimeter edge of the backing plate 40. A fluid conduit 47 through the driveshaft 31, the backing plate 40 and the pad 43 couples a fluid supply (not shown) with a cell 48 between the bladder 46 and the pad 43. The fluid supply can drive fluid into the cell 48 to inflate the bladder 46, or the fluid supply can withdraw fluid from the cell 48 to deflate the bladder 46.

To planarize the substrate assembly 12, the carrier head 33 retains the substrate assembly 12 on a planarizing surface 52 of the polishing pad 50 in the presence of a planarizing fluid 60. The bladder 46 inflates to exert a desired downforce against the substrate assembly 12, and the carrier head 33 moves and/or rotates the substrate assembly 12. As the substrate assembly 12 moves across the planarizing surface 52, abrasive particles and/or chemicals in either the polishing pad 50 or the planarizing solution 60 remove material from the surface of the substrate assembly 12.

CMP processes must consistently and accurately produce a uniformly planar surface on the substrate assembly to enable precise fabrication of circuits and photo-patterns. One aspect of forming components on semiconductor or other microelectronic-device substrate assemblies is photo-patterning designs to within tolerances as small as approximately 0.1 μm. Many semiconductor fabrication processes, however, create highly topographic surfaces with large "step heights" that significantly increase the difficulty of forming sub-micron features or photo-patterns to within such small tolerances. Thus, CMP processes are often used to transform a topographical substrate surface into a highly uniform, planar substrate surface (e.g., a "blanket surface").

In the competitive semiconductor industry, it is also desirable to maximize the throughput of CMP processing by producing a blanket substrate surface as quickly as possible without sacrificing the accuracy of the process. The throughput of CMP processing is a function of several factors, one of which is the ability to accurately form a flat, planar surface across as much surface area on the substrate assembly as possible. Another factor influencing the throughput of CMP processing is the ability to stop planarization at a desired endpoint in the substrate assembly. In a typical CMP process, the desired endpoint is reached when the surface of the substrate is a blanket surface and/or when enough material has been removed from the substrate assembly to form discrete components on the substrate assembly (e.g., shallow trench isolation areas, contacts, damascene lines, etc.). Accurately stopping CMP processing at a desired endpoint is important for maintaining a high throughput because an "under-planarized substrate assembly may need to be re-polished, or an "over-planarized" substrate assembly may be damaged. Thus, CMP processing should be consistent from one wafer to another to accurately form a blanket surface at the desired endpoint.

One drawback of the Applied Materials carrier head 33 shown in FIG. 1 is that the low-friction pad 43 wears out and needs to be replaced. In a typical application, for example, vertical displacement of the substrate assembly 12 and the backing plate 40 causes the bladder 46 to periodically engage the perimeter of the pad 43. The contact between the bladder 46 and the pad 43 wears down the perimeter surface of the pad 43 to a point at which the pad 43 must be replaced. Replacing the pad 43, however, is time-consuming because the bladder 46 and the pad 43 must be removed from the backing plate 40. Therefore, the Applied Materials carrier head 33 illustrated in FIG. 1 is subject to downtime that reduces the throughput of CMP processing.

Another drawback of the carrier head 33 is that it may produce inconsistent, non-planar surface features at the edge of a substrate assembly. The planarity of the substrate assembly is a function of, at least in part, the pressure exerted on the substrate assembly by the bladder 46. The contour of the perimeter region 45 of the low-friction pad 43 may affect the force exerted on the perimeter of the substrate assembly 12. For example, because the substrate assembly 12 may press the bladder 46 against the perimeter region 45 of the pad 43 during planarization, the contour of the perimeter region 45 can directly affect the force exerted against the perimeter of the substrate assembly 12. The shape of the perimeter region 45 of the pad 43, however, may be inconsistent over the life of a single pad 43 or from one pad 43 to another. One reason that the shape of the pad 43 may change is because the perimeter region 45 of the pad 43 compresses after a period of use. Moreover, and even more problematic, the shape of the perimeter region 45 may be different from one pad 43 to another because each pad 43 is manually attached to the backing plate 40. Therefore, the inconsistencies of the pad 43 may produce inconsistent, non-planar surface features at the edge of the substrate assemblies.

SUMMARY OF THE INVENTION

The present invention is directed toward planarizing machines, carrier heads for planarizing machines, and methods for planarizing microelectronic-device substrate assemblies in mechanical or chemical-mechanical planarizing processes. In one embodiment of the invention, a carrier head includes a backing plate, a bladder attached to the backing plate, and a retaining ring extending around the backing plate and the bladder. The backing plate has a perimeter edge, a first surface, and a second surface opposite the first surface. The second surface of the backing plate can have a perimeter region extending inwardly from the perimeter edge and an interior region extending inwardly from the perimeter region. The backing plate can further include a permanent, low-friction coating over at least a portion of the second surface. The bladder is configured to extend over the second surface of the backing plate to form a fluid cell between the bladder and the second surface. In operation, a fluid can flow through the backing plate to inflate/deflate the bladder.

In another embodiment of the invention, the backing plate has at least one hole defining a fluid passageway, and the perimeter region of the second surface has a fixed curvature. The perimeter region, for example, can have a rim extending inwardly from the perimeter edge of the backing plate and curved section extending inwardly from the rim. The perimeter region can alternatively have only a curved section extending inwardly directly from the perimeter edge of the backing plate. The curved section can curve toward and/or away from the first surface to influence the edge pressure exerted against the substrate assembly during planarization.

In operation, the carrier head holds a backside of a substrate assembly against the bladder within the retaining ring. The carrier head then places the substrate assembly on a planarizing surface of a polishing pad and inflates the bladder to exert a desired down force against the substrate assembly. The carrier head also translates the substrate assembly across the planarizing surface to remove material from the front side of the substrate assembly.

DETAILED DESCRIPTION OF THE INVENTION

The present invention is directed toward methods and apparatuses for mechanical and/or chemical-mechanical planarization of microelectronic-device substrate assemblies. Many specific details of certain embodiments of the invention are set forth in FIGS. 2–5 and the following description to provide a thorough understanding of such embodiments. One skilled in the art, however, will understand that the present invention may have additional embodiments, or that certain embodiments of the invention may be practiced without several of the details described in the following description.

Figure 2:
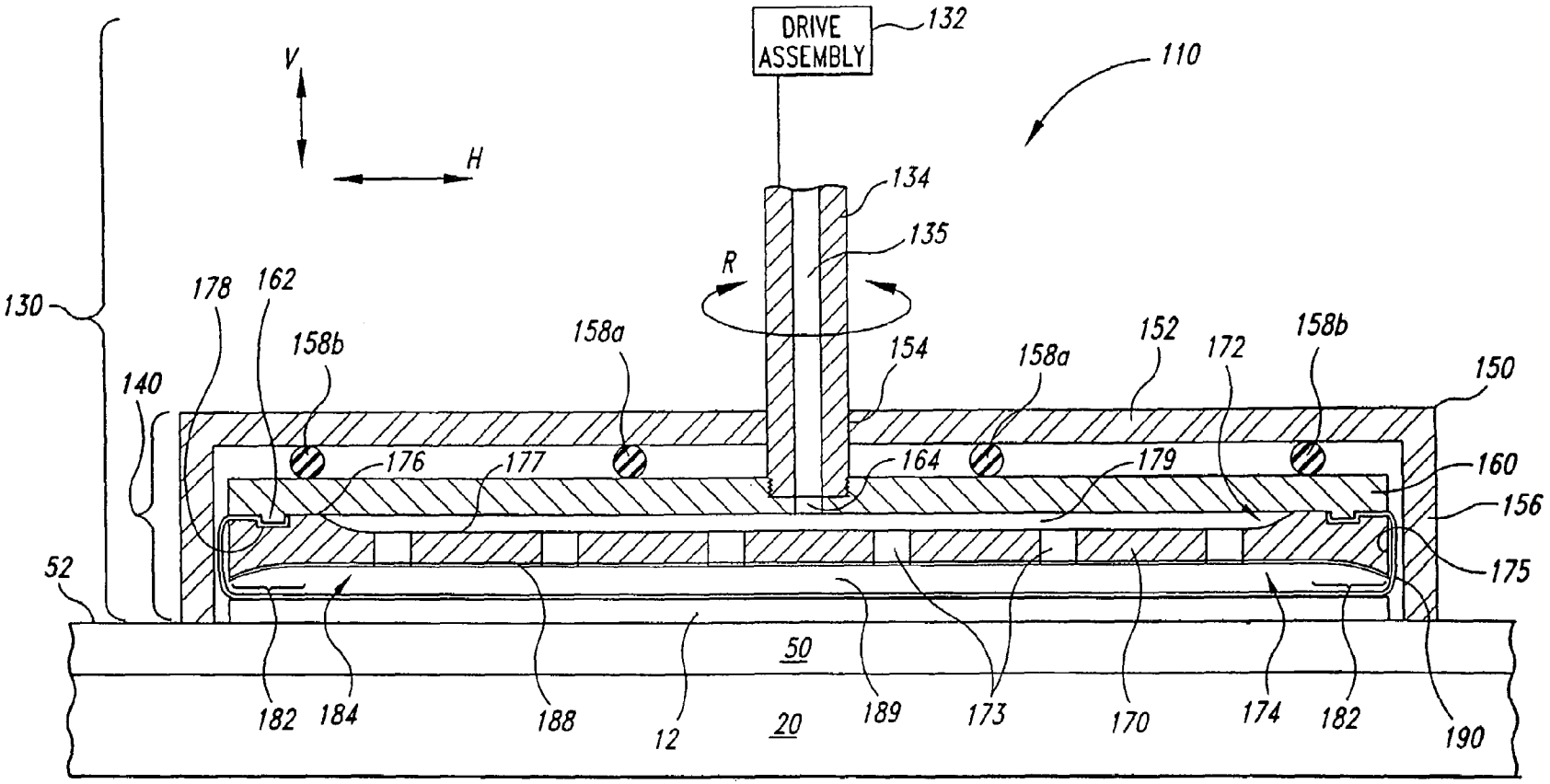
FIG. 2 is a schematic cross-sectional view of a carrier head for a planarizing machine in accordance with one embodiment of the invention.

FIG. 2 is a schematic cross-sectional view partially illustrating a planarizing machine 110 including a carrier assembly 130 having a drive assembly 132 and a carrier head 140 in accordance with one embodiment of the invention. The drive assembly 132 can have an arm or gantry (not shown) with a plurality of actuators (not shown) to move the carrier head 140 vertically (arrow V), horizontally (arrow H), and/or rotationally (arrow R). The drive assembly 132 has a driveshaft 134 including a conduit 135 coupled to a pump (not shown), such as a dual direction pump to drive a fluid (e.g., air or water) through the conduit 135. Suitable drive assemblies for operating the carrier head 140 are manufactured by EDC Obsidian Corporation, Westech Corporation, Strasbaugh Corporation and Applied Materials Corporation.

The carrier head 140 of this embodiment includes a housing 150 coupled to the drive shaft 134, a cover plate 160 connected to the driveshaft 134, and a backing plate 170 attached to the cover plate 160. The carrier head 140 can also include a bladder or flexible membrane 190 attached to the backing plate 170. As described in more detail below, the carrier head 140 moves a substrate assembly 12 across the planarizing surface 52 of the polishing pad 50.

The housing 150 of this embodiment includes a support member 152 and a retaining ring 156 depending from the support member 152. The support member 152 can be a circular plate with a hole 154 to receive the driveshaft 134 so that the shaft 134 can rotate independently from the housing 150. Additionally, the hole 154 in the support member 152 allows vertical displacement between the cover plate 160/backing plate 170 assembly and the housing 150. In one embodiment, a bushing (not shown) can couple the support member 152 to the drive shaft 134 to allow the drive shaft 134 to rotate freely with respect to the housing 150. The support member 152 can alternatively be a bar extending over the cover plate 160. The retaining ring 156 can accordingly extend downwardly from either a plate-type or bar-type support member 152 to surround the cover plate 160, the backing plate 170, and the substrate assembly 12. The housing 150 is spaced apart from the cover plate by a number of inner tubes 158*a* and 158*b*, or another type of resilient and compressible spacer.

The cover plate 160 is an optional component of the carrier head 140. In this embodiment, the cover plate 160 has an annular tongue 162 and a hole 164 open to the conduit 135. The hole 164 thus allows a fluid to pass through the cover plate 160. The cover plate 160 is fixedly attached to the driveshaft 134, and thus rotation of the drive shaft 134 directly rotates the cover plate 160. The cover plate 160, for example, can be welded, threaded or otherwise fixedly attached to the drive shaft 134.

The backing plate 170 shown in FIG. 2 is fixedly attached to the cover plate 160 by a number of bolts, screws or other fasteners (not shown). In another embodiment, the backing plate 170 can be attached directly to the drive shaft 134 to eliminate the cover plate 160 from the carrier head 140. The backing plate 170 has a first surface 172 facing the support member 152, a second surface 174 facing the polishing pad 50, and a perimeter edge 175. The first surface 172 of the backing plate 170 can have a lip 176 extending inwardly from the perimeter edge 175 and a depression 177 within the lip 176. The lip 176 can have an annular groove 178 configured to receive the annular tongue 162 of the cover plate 160. The depression 177 in the first surface 172 and the cover plate 160 define a cavity 179 to distribute the fluid from the conduit 135 over the backing plate 170. The second surface 174 of the backing plate 170 has a perimeter region 182 extending inwardly from the perimeter edge 175 and an interior region 184 extending inwardly from the perimeter region 182. The perimeter region 182 can be a planar section, or the perimeter region 182 can be a curved section that curves toward or away from the first surface 174 of the backing plate 170. The backing plate 170 can further include a plurality of holes 173 to pass the fluid through the backing plate 170.

The backing plate 170 can be a metal plate composed of aluminum, steel, or another suitable type of metal. The backing plate 170 can alternatively be composed of a hard polymer or other type of hard, rigid material. As such, the perimeter region 182 is a fixed, permanent component of the backing plate 170 that is molded, machined or otherwise fabricated on the second surface 174.

The second surface 174 of the backing plate 170 is additionally covered with a permanent, low-friction film or coating 188. Suitable coating materials include DF-200 manufactured by Rodel Corporation, Teflon® manufactured by E.I. du Pont de Nemours, or other suitable low-friction or non-stick materials. The coating layer 188, for example, can be deposited onto the second surface 174 in a manner similar to coating the surface of non-stick cookware. The low-friction coating 188 protects the bladder 190 from being damaged during planarizing. For example, without the low-friction coating 188, the perimeter of the bladder 190 can be damaged because vertical displacement between the substrate assembly 12 and the backing plate 170 can occur to the extent that the perimeter of the bladder 190 can be compressed between the perimeter region 182 of the backing plate 170 and the substrate assembly 12. Additionally, the substrate assembly 12 may flex or bow during planarization to the extent that the interior region of the bladder 190 can be compressed between the interior region 184 of the backing plate 170 and the substrate assembly 12. The low-friction coating 188 protects the bladder 190 from tearing or prematurely wearing when it is compressed between the substrate assembly 12 and the backing plate 170 by reducing the coefficient of function across the backing plate 170.

The bladder 190 can be attached to the backing plate 170 to extend over the second surface 174. In one embodiment, for example, a portion of the bladder 190 can be clamped between the tongue 162 of the cover plate 160 and the groove 178 of the backing plate 170. In another embodiment, a clamp-ring (not shown) can clamp the bladder 190 to the perimeter edge 175 of the backing plate 170. The second surface 174 of the backing plate 170 and the portion of the bladder 190 extending over the second surface 174 define a fluid cell 189. In operation, a fluid passes through the conduit 135, the cavity 179 and the holes 173 to inflate or deflate the bladder 190. As explained in more detail below, the shape of the perimeter region 182 of the second surface 174 influences the pressure exerted against the perimeter region of the substrate assembly 12 during planarization.

Figure 3:
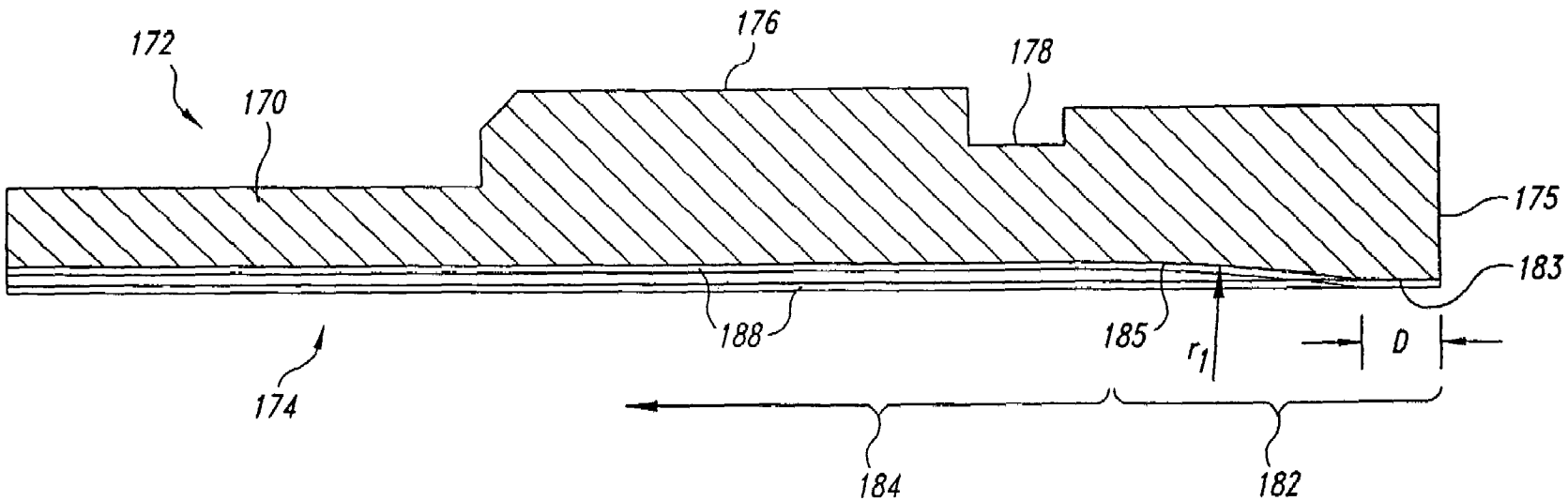
FIG. 3 is a partial cross-sectional view of a backing plate for a carrier head in accordance with one embodiment of the invention.
Figure 4:
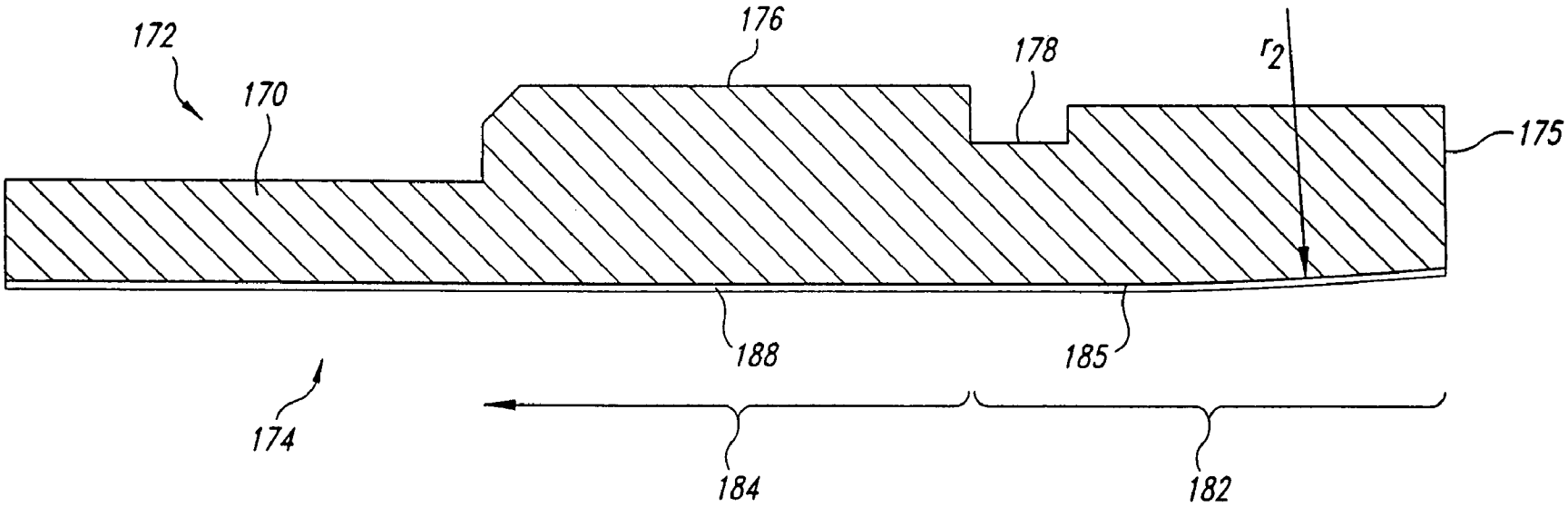
FIG. 4 is a partial cross-sectional view of another backing plate for a carrier head in accordance with another embodiment of the invention.

FIGS. 3 and 4 illustrate various embodiments of the perimeter region 182 of the backing plate 170 in greater detail. Referring to FIG. 3, the perimeter region 182 includes a rim 183 extending inwardly from the perimeter edge 175 by a distance "D" and a curved section 185 extending inwardly from the rim 183. The interior region 184 of the second surface 174 extends inwardly from the curved section 185. The curved section 185 of this embodiment curves toward the first surface 172 at a radius "$r_1$" such that the interior region 184 is recessed from the rim 183. In one particular embodiment the distance D is 0.122 inch and the radius $r_1$ is 2.0 inches, and in another embodiment the distance D is 0.06 inch and the radius $r_1$ is 3.9 inches. FIG. 4 illustrates another embodiment in which the perimeter region 182 includes a curved section 185 extending inwardly from the perimeter edge 175 and curving away from the first surface 174 to the interior region 184. The radius of curvature "$r_2$" of the perimeter region 182 shown in FIG. 4 can be approximately 4.6 inches. In still another embodiment (not shown), the perimeter region 182 is a flat section at the same elevation as the interior region 184 such that the second surface 174 is planar. As such, the perimeter region 182 can be a curved or flat section that extends inwardly from either the rim 183 or the perimeter edge 175, and the curved section 185 can curve either toward or away from the first surface 172. Referring to FIGS. 3 and 4 together, the low friction coating 188 covers the second surface 174 of the backing plate 170 to protect the bladder 190 (FIG. 2) from damage during planarization.

The contour of the perimeter region 182 of the second surface 174 influences the pressure exerted by the bladder 190 against the perimeter of the substrate assembly 12. For example, when a significant amount of vertical displacement occurs between the backing plate 170 and the substrate assembly 12 during planarization, the perimeter portion 182 of the second surface 174 may directly press an edge portion of the bladder 190 against the backside of the substrate assembly 12. The contour of the perimeter region 182 of the second surface 174 can accordingly influence the force exerted against the perimeter region of the substrate assembly 12.

Figure 5:
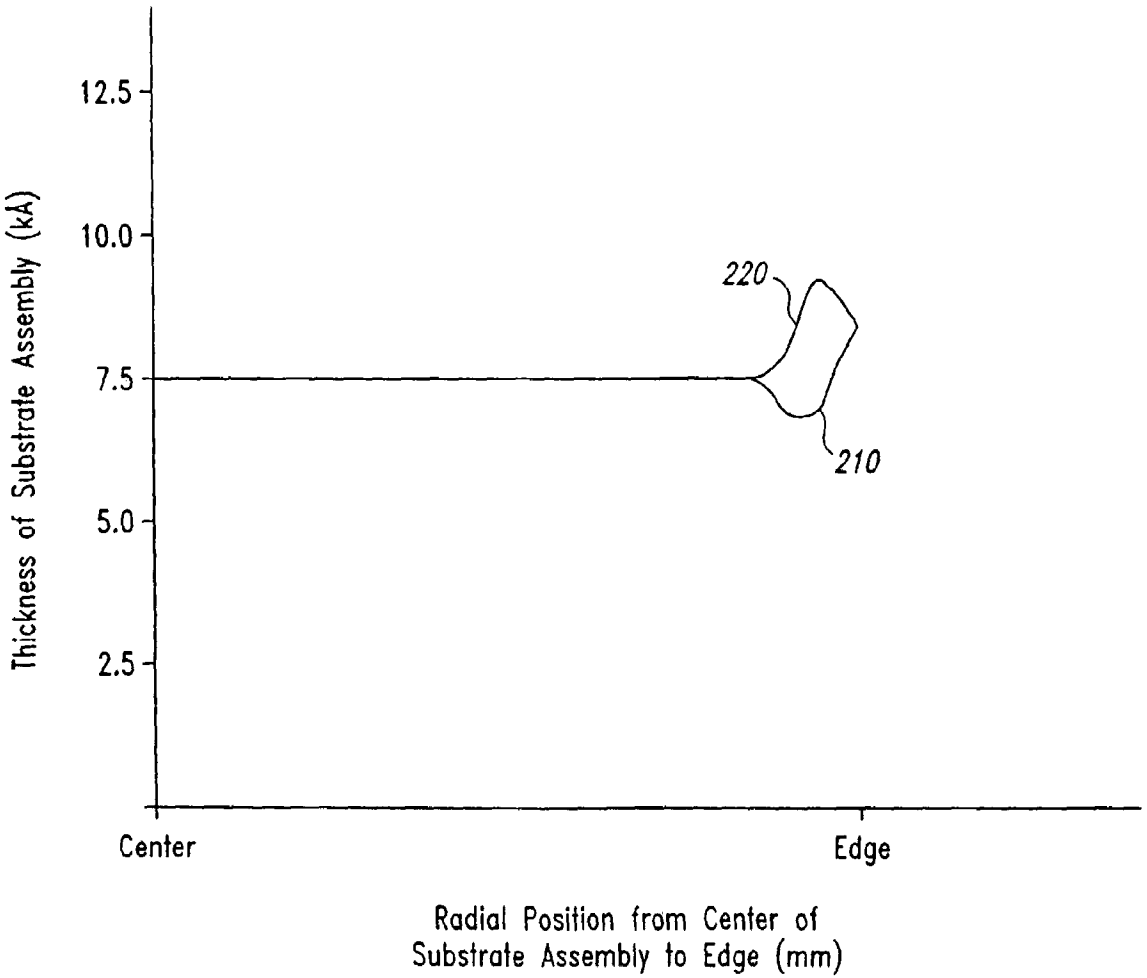
FIG. 5 is a graph illustrating the thickness of substrate assemblies with respect to the radial position across the substrate assemblies for substrate assemblies planarized with different backing plates.

FIG. 5 is a graph illustrating the thickness of substrate assemblies with respect to the radial position on the substrate assemblies. Contour line 210, more specifically, illustrates the thickness of a substrate assembly planarized with a carrier head having a backing plate in which the perimeter region of the second surface has a rim and a curved section that curves upwardly toward the first surface of the backing plate (as shown in FIG. 3). Contour line 220 illustrates the thickness of a substrate assembly planarized with a carrier head having a backing plate in which the curved section curves downwardly away from the first surface of the backing plate (as shown in FIG. 4). The radial location and extent that the thickness of the substrate assembly 12 varies at the perimeter edge can thus be partially controlled by the contour of the perimeter region 182 of the second surface 174.

The operation of the carrier head 140 is best illustrated in FIG. 2. Before placing the substrate assembly 12 on the polishing pad 50, the carrier head picks up the substrate assembly 12 by pressing the bladder 190 against the backside of the substrate assembly 12 and drawing fluid out of the fluid cell 189. The fluid draws the bladder 190 partially through the holes 173 in the backing plate 170, and the portions of the bladder 190 drawn into the holes 173 create suction points that hold the substrate assembly 12 to the bladder. The drive assembly 132 then moves the carrier head 140 over the polishing pad 50 and lowers the carrier head 140 until the substrate assembly 12 and/or the retaining ring 156 engages the planarizing surface 52. The fluid cell 189 is then filled with fluid to exert the desired downforce against the substrate assembly 12 via the bladder 190. The retaining ring 156 holds the substrate assembly 12 under the bladder 190, and the drive assembly 132 moves the carrier head 140 and substrate assembly 12 across the polishing pad 50. The relative movement between the substrate assembly 12 and the polishing pad 50 in the presence of a planarizing solution removes material from the front side of the substrate assembly 12.

Figure 1:
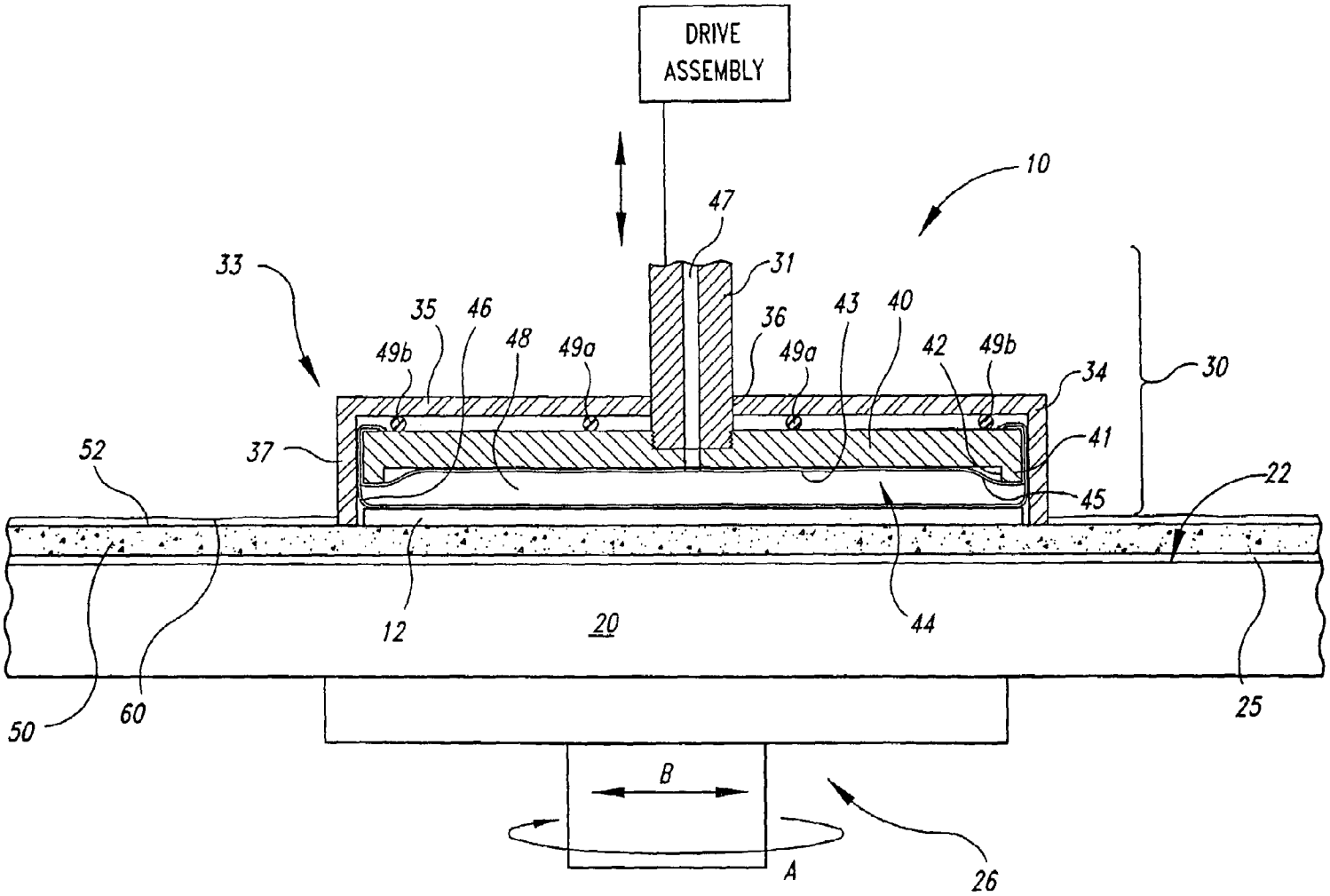
Fig. 1 (Prior Art)
FIG. 1 is a schematic cross-sectional view of a carrier head for a planarizing machine in accordance with the prior art.

The embodiments of the carrier head 140 shown in FIGS. 2–4 are expected to reduce the down-time for repairing and maintaining the carrier head 140 compared to the Applied Materials carrier head shown in FIG. 1. The permanent low-friction coating 188 on the second surface 174 of the backing plate 170 protects the bladder 190 from ripping when it contacts the backing plate 170. The low-friction coating 188 accordingly eliminates the need for a separate backing pad attached to the backing plate 170 in the carrier head 140. The Applied Materials carrier head, however, requires a separate backing pad 43 (FIG. 1) that wears down and must be replaced periodically. Thus, unlike the Applied Materials carrier head, the carrier head 140 does not need to be periodically disassembled and reassembled to change out disposable backing pads. The carrier head 140 accordingly eliminates a consumable component to reduce the down-time for repairing and maintaining the carrier head.

Moreover, the embodiments of the carrier head 140 shown in FIGS. 2–4 are also expected to produce more consistent planarizing results than the Applied Materials carrier head shown in FIG. 1. Because the perimeter portion 182 of second surface 174 has a permanent, fixed contour, the backing plate 170 produces a consistent perimeter force distribution for a large number of substrate assemblies. The Applied Materials carrier head, however, may not produce such a consistent perimeter force distribution because the contour of the backing pad 43 (FIG. 1) may change over the life of the pad 43. Moreover, because the backing pads 43 are manually attached to the Applied Materials carrier head, the contour of one backing pad 43 may be different than another. Thus, the permanent and fixed perimeter portion 182 of the backing plate 170 eliminates a processing variable that can result in inconsistent planarizing results.

From the foregoing it will be appreciated that, although specific embodiments of the invention have been described herein for purposes of illustration, various modifications may be made without deviating from the spirit and scope of the invention. The backing plate 170 and low-friction coating 188, for example, can be composed of materials different than those disclosed above. Additionally, the perimeter region 182 of the backing plate 170 can have additional configurations other than those disclosed above, such as compound curve surfaces with multiple curves. Accordingly, the invention is not limited except as by the appended claims.

The invention claimed is:

1. In mechanical or chemical-mechanical planarization of microelectronic-device substrate assemblies, a method of supporting a backside of a microelectronic-device substrate assembly, comprising:

expanding a bladder over a fixed, curved perimeter region of a shaping surface of a backing plate, the curved perimeter region defining a shape of an edge region of the expanded bladder; and pressing the expanded bladder against the microelectronic-device substrate assembly.

2. The method of claim 1, wherein expanding a bladder comprises filling the bladder with a fluid; and pressing the expanded bladder comprises exerting a predetermined down force on the microelectronic-device substrate assembly.

3. The method of claim 1, wherein pressing the expanded bladder further comprises retaining the microelectronic-device substrate assembly under the bladder with a retaining ring that at least partially surrounds the substrate.

4. The method of claim 1, wherein expanding a bladder further comprises pressing a portion of the backing plate against the microelectronic-device substrate assembly.

5. The method of claim 4, wherein pressing a portion of the backing plate against the microelectronic-device substrate assembly further comprises pressing the curved perimeter region of the backing plate against a perimeter region of the microelectronic-device substrate assembly.

6. The method of claim 1, wherein the curved perimeter region comprises a convex surface.

7. The method of claim 1, wherein the curved perimeter region comprises a concave surface.

8. In mechanical or chemical-mechanical planarization of microelectronic-device substrate assemblies, a method of supporting a backside of a microelectronic-device substrate assembly, comprising:

shaping an edge region of a bladder over a solid low-friction perimeter region of a backing plate having a fixed contour that imparts a desired shape to the edge region; and pressing the shaped bladder against the microelectronic-device substrate assembly.

9. The method of claim 8, wherein pressing the shaped bladder further comprises inflating the bladder over the backing plate.

10. The method of claim 9, wherein inflating the bladder further comprises inflating the bladder to a desired pressure and applying a predetermined down force on the microelectronic-device substrate assembly.

11. The method of claim 8, wherein shaping an edge region further includes pressing the perimeter region of the backing plate against the microelectronic-substrate assembly.

12. The method of claim 8, wherein the fixed contour comprises a fixed convex contour.

13. The method of claim 8, wherein the fixed contour comprises a fixed concave contour.

14. In the fabrication of microelectronic-device substrate assemblies, a method of mechanical or chemical-mechanical planarization of a microelectronic-device substrate assembly, comprising:

driving the substrate assembly against a planarizing surface of a polishing pad by expanding a bladder over a fixed, curved perimeter region of a backing plate and pressing the expanded bladder against the substrate assembly, the curved perimeter region having a fixed shaping surface and a low-friction coating to define a shape of an edge region of the bladder; and moving at least one of the substrate assembly or the polishing pad with respect to the other to impart relative motion therebetween and remove material from the substrate assembly.

15. The method of claim 14, further comprising pressing the bladder against a backside of the microelectronic-device substrate assembly to hold the microelectronic-device substrate assembly against the bladder.

16. The method of claim 15, wherein pressing the bladder further includes contracting the bladder to retain the microelectronic-device substrate assembly against the bladder.

17. The method of claim 14, wherein driving the microelectronic-device substrate assembly against a planarizing surface further comprises filling the bladder with a fluid.

18. The method of claim 17, wherein filling the bladder with a fluid further comprises inflating the bladder to a desired pressure; and pressing the expanded bladder against the substrate assembly further comprises applying a force corresponding to the pressure to the microelectronic-substrate assembly.

19. The method of claim 14, wherein moving at least one of the substrate assembly or the polishing pad further comprises retaining the microelectronic-device substrate assembly with a retaining ring that at least partially surrounds the microelectronic- device substrate assembly while the substrate is positioned between the bladder and the planarizing surface.

20. The method of claim 14, wherein the fixed shaping surface comprises a fixed convex surface.

21. The method of claim 14, wherein the fixed shaping surface comprises a fixed concave surface.

* * * * *